US009194093B2

(12) United States Patent
Brandis et al.

(10) Patent No.: US 9,194,093 B2
(45) Date of Patent: Nov. 24, 2015

(54) WATER-POWERED PUMP FOR USE IN IRRIGATION AND FOR OTHER PURPOSES

(75) Inventors: Joost Brender A. Brandis, Wilmington, NC (US); Jeffrey Lynn McKay, Wilmington, NC (US)

(73) Assignee: The Full Belly Project Ltd., Wilmington, NC (US)

( * ) Notice: Subject to any disclaimer, the term of this patent is extended or adjusted under 35 U.S.C. 154(b) by 603 days.

(21) Appl. No.: 13/152,228

(22) Filed: Jun. 2, 2011

(65) Prior Publication Data

US 2012/0308411 A1 Dec. 6, 2012

(51) Int. Cl.

| | |
|---|---|
| ***E02B 13/00*** | (2006.01) |
| ***F04B 9/111*** | (2006.01) |
| ***F04B 9/113*** | (2006.01) |
| ***F04B 9/14*** | (2006.01) |

(52) U.S. Cl.

CPC ..... *E02B 13/00* (2013.01); *F04B 9/111* (2013.01); *F04B 9/113* (2013.01); *F04B 9/14* (2013.01); *E02B 2201/50* (2013.01)

(58) Field of Classification Search

CPC ..... E02B 13/00; E02B 2201/50; F04B 9/105; F04B 9/107; F04B 9/111; F04B 9/113; F04B 15/023; F04B 17/00; F04B 43/06; F04B 47/04

USPC ..... 417/329, 375, 383, 390, 399, 403

See application file for complete search history.

(56) References Cited

U.S. PATENT DOCUMENTS

| | | | | |
|---|---|---|---|---|
| 4,537,563 | A | 8/1985 | Ogawa | |
| 4,911,613 | A | 3/1990 | Cox | |
| 5,975,360 | A * | 11/1999 | Ophardt | 222/83 |
| 6,036,104 | A * | 3/2000 | Shih | 239/63 |
| 6,644,937 | B2 | 11/2003 | Han | |
| 7,927,161 | B2 * | 4/2011 | Schaefer, Jr. | 440/88 F |
| 2006/0216163 | A1 | 9/2006 | Park | |

OTHER PUBLICATIONS

Weisman, Alan, Gaviotas: A Village to Reinvent the World, Chelsea Green Publishing 1998.

Declaration of Joost Brender a Brandis dated Jun. 20, 2012.

* cited by examiner

*Primary Examiner* — Devon Kramer
*Assistant Examiner* — Patrick Hamo
(74) *Attorney, Agent, or Firm* — Fried, Frank, Harris, Shriver & Jacobson LLP

(57) ABSTRACT

The present invention is directed to a water pump that may be easily constructed from inexpensive parts and materials and that is powered by the water source from which the water to be pumped is drawn. In a preferred embodiment, two pairs of lever arms located on opposite sides of the pump are alternately filled with water from the source and then emptied causing the lever arms to alternately ascend and descend. As the lever arms ascend and descend, they alternately fill and then compress a pair of pistons causing water to be pumped to an outlet of the pump. Water from the emptied lever arms may preferably be returned to the source, thus minimizing any impact of the pump on the environment and downstream users of the water source.

13 Claims, 13 Drawing Sheets

WATER-POWERED PUMP FOR USE IN IRRIGATION AND FOR OTHER PURPOSES

FIELD OF THE INVENTION

This invention relates generally to the field of pumps and, more specifically, is directed to a pump that may be constructed of inexpensive materials and uses the kinetic and/or potential energy in a source of water to power the pump.

BACKGROUND OF THE INVENTION

Although there exist a wide variety of water pumping systems for farm irrigation and other purposes, most such systems are complex, expensive, and require electricity or some other form of man-made power for their operation. In many underdeveloped or depressed areas, however, farmers and other persons requiring water for crop irrigation or other purposes cannot afford to install or maintain expensive pumping systems. Moreover, in many contexts, such as relatively small organic farms built to supply produce to local consumers and restaurants, the amount of water needed may not justify a complex pumping system. Furthermore, in remote areas, access to electricity or other man-made power sources may not always be readily available. Accordingly, there exists a need for inexpensive water pumps that are easy to construct and maintain, don't require access to man-made power sources, and can supply water in volumes needed for relatively small farms and other applications with relatively modest water demands.

SUMMARY OF THE INVENTION

The present invention addresses the above need and is directed to a water pump that may be easily constructed from inexpensive parts and materials and that is powered by the water source from which the water to be pumped is drawn. In a preferred embodiment, two pairs of lever arms located on opposite sides of the pump are alternately filled with water from the source and emptied. A relatively small amount of water from the source is separately directed via a first pair of one-way valves to a pair of pistons. As the lever arms fill and empty, they ascend and descend, alternately filling and then compressing each piston. Compression of the pistons causes water to be pumped through a second pair of one-way valves to an outlet of the pump. Water from the emptied lever arms is preferably returned to the source, thus minimizing any impact of the pump on the environment and downstream users of the water source.

The pump of the present invention provides many advantages, including that it is "self-bleeding" in that it prevents air from collecting in the pump which would reduce pumping efficiency. The structure of the pump of the present invention is preferably relatively "open" to minimize resistance against a flowing water source and minimize any tendency for the water source to push the pump downstream. The pump is also preferably of relatively modest height to minimize the amount of kinetic or potential energy in the water required to drive the pump, particularly where the energy for driving the pump is created by damming the water source since it may not be possible or desirable to increase the height of the dam to provide more energy.

DETAILED DESCRIPTION OF THE PREFERRED EMBODIMENTS

Figure 1:
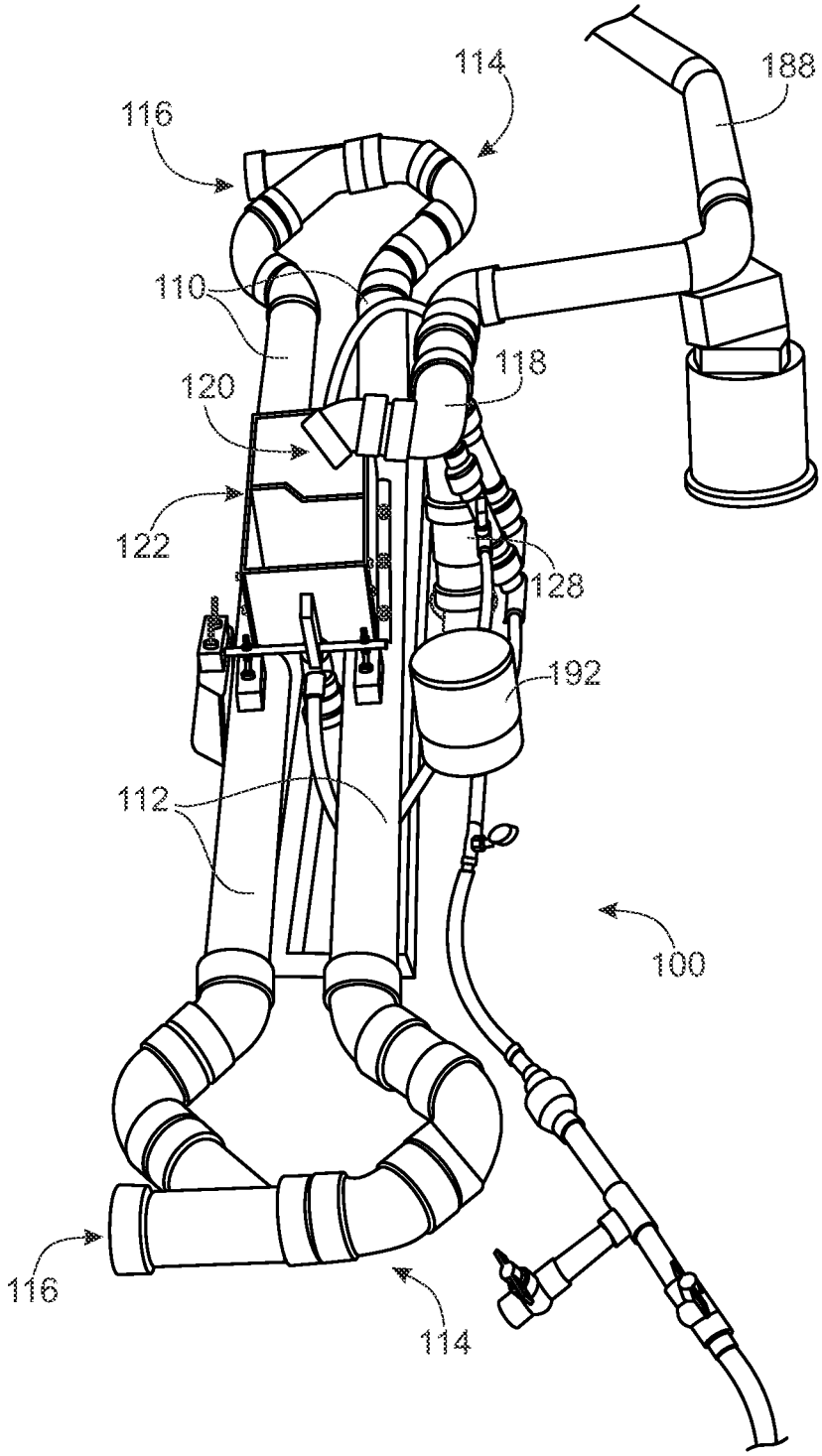
FIG. 1 illustrates a preferred embodiment of the pump of the present invention.
Figure 2:
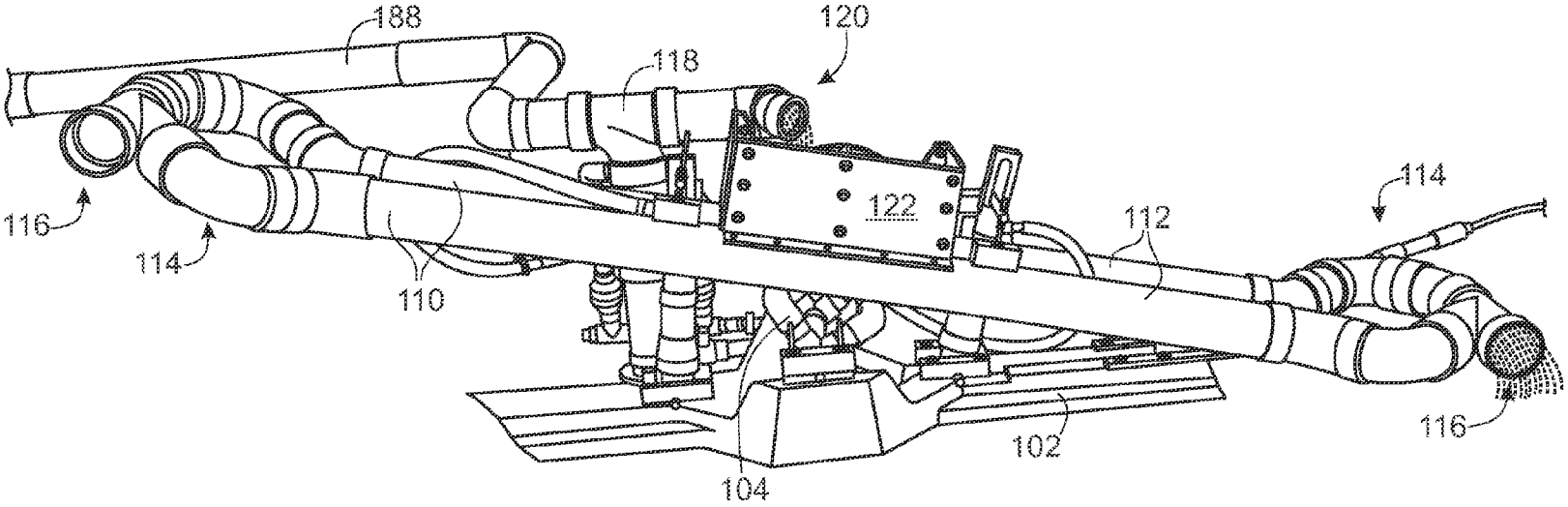
FIG. 2 illustrates aspects of the pump shown in FIG. 1 viewed from the front with the pump's rotating assembly in a first position (rotated clockwise)
Figure 3:
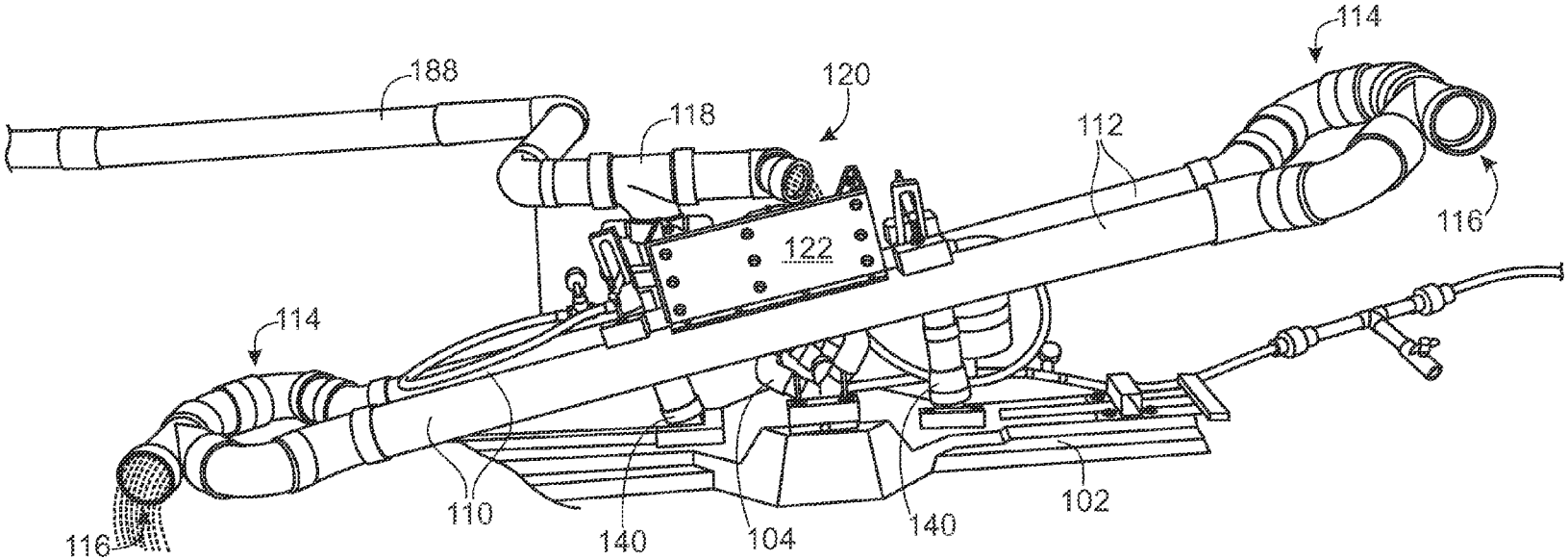
FIG. 3 illustrates aspects of the pump shown in FIG. 1 viewed from the front with the pump's rotating assembly in a second position (rotated counterclockwise)
Figure 4:
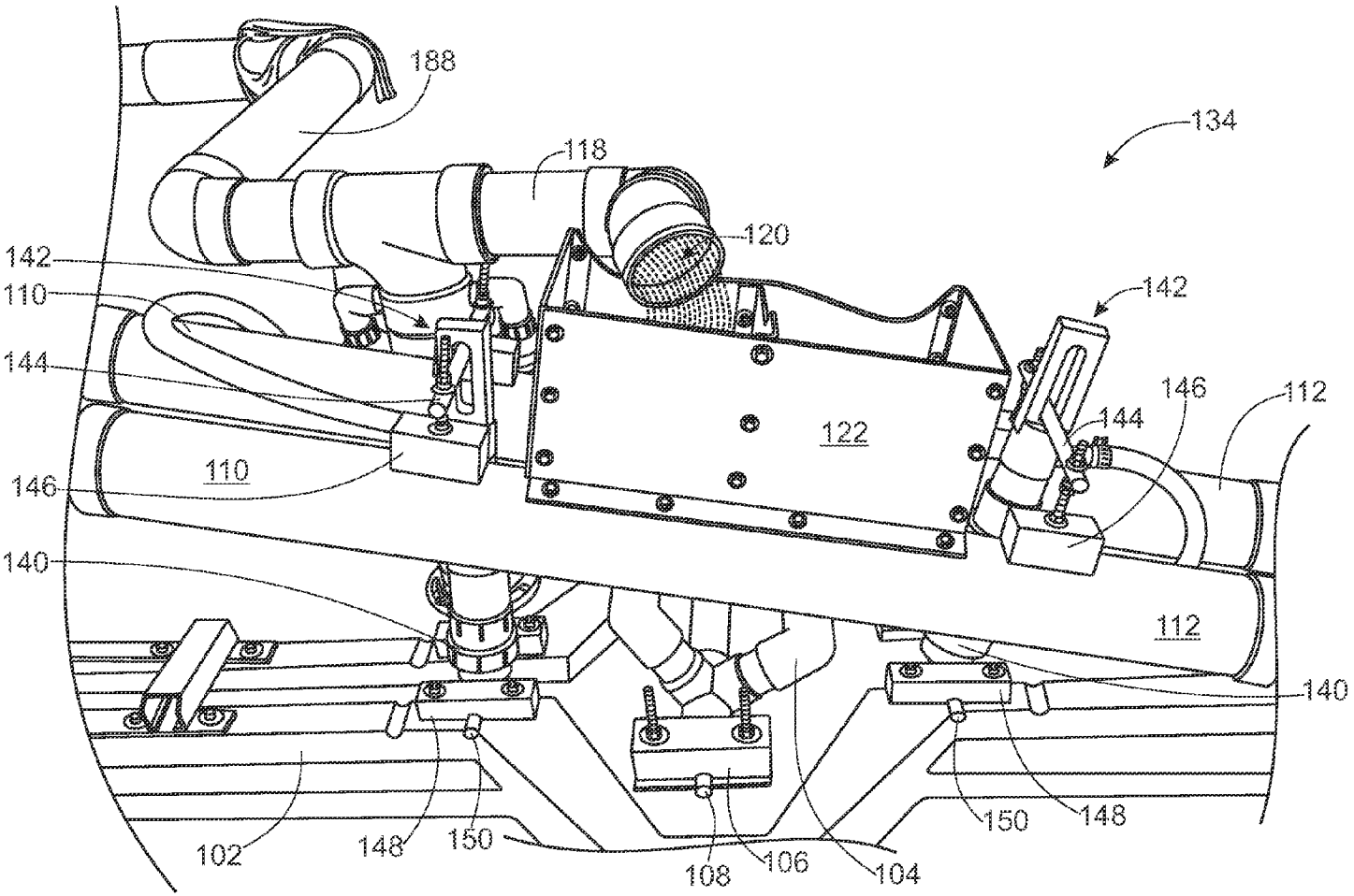
FIG. 4 illustrates aspects of the pump shown in FIG. 1 viewed from the front with the pump's rotating assembly in the first position.
Figure 5:
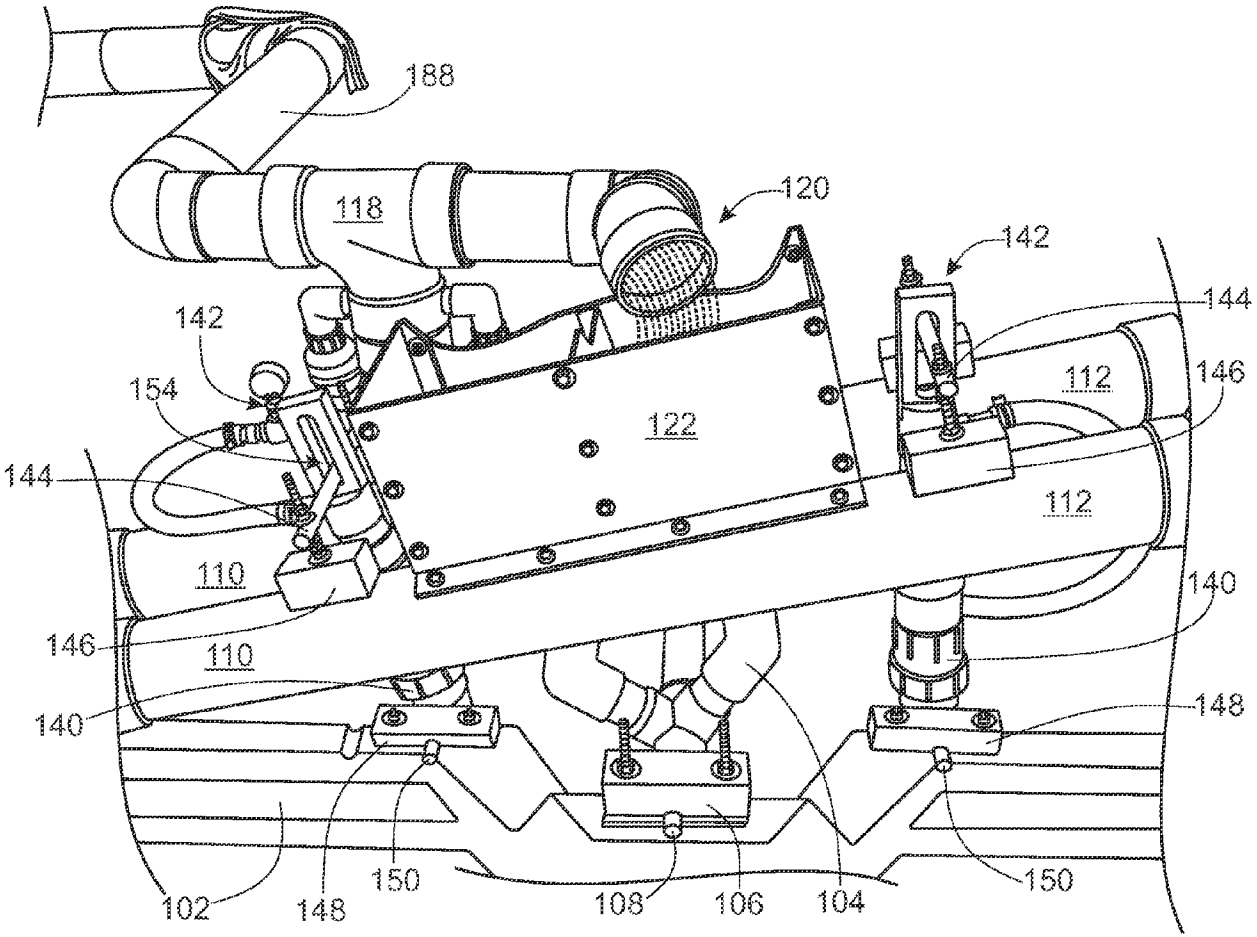
FIG. 5 illustrates aspects of the pump shown in FIG. 1 viewed from the front with the pump's rotating assembly in the second position.
Figure 6:
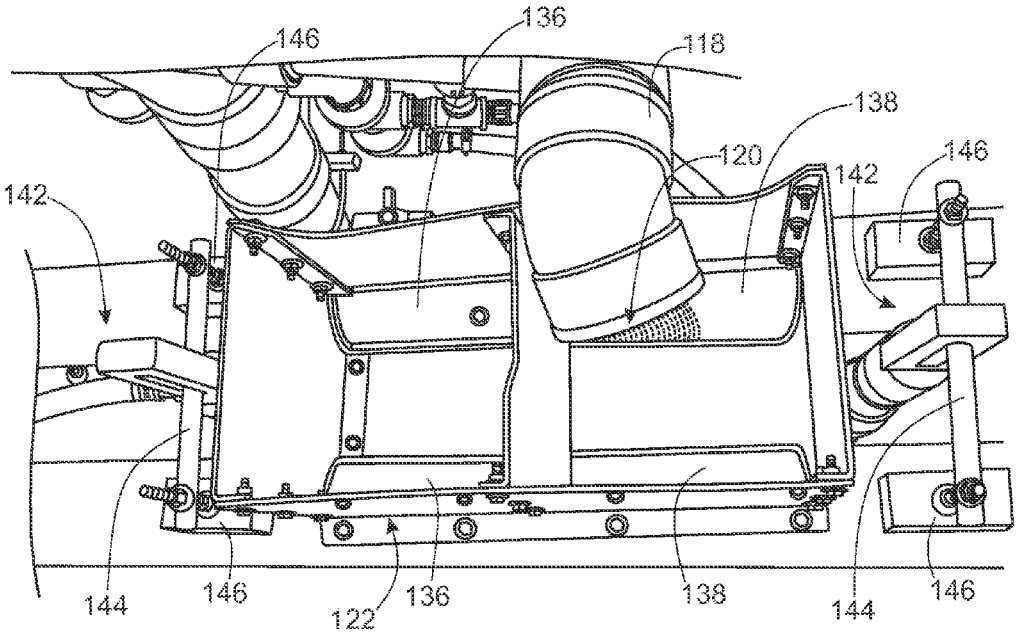
FIG. 6 illustrates aspects of the pump shown in FIG. 1 viewed from above.
Figure 7:
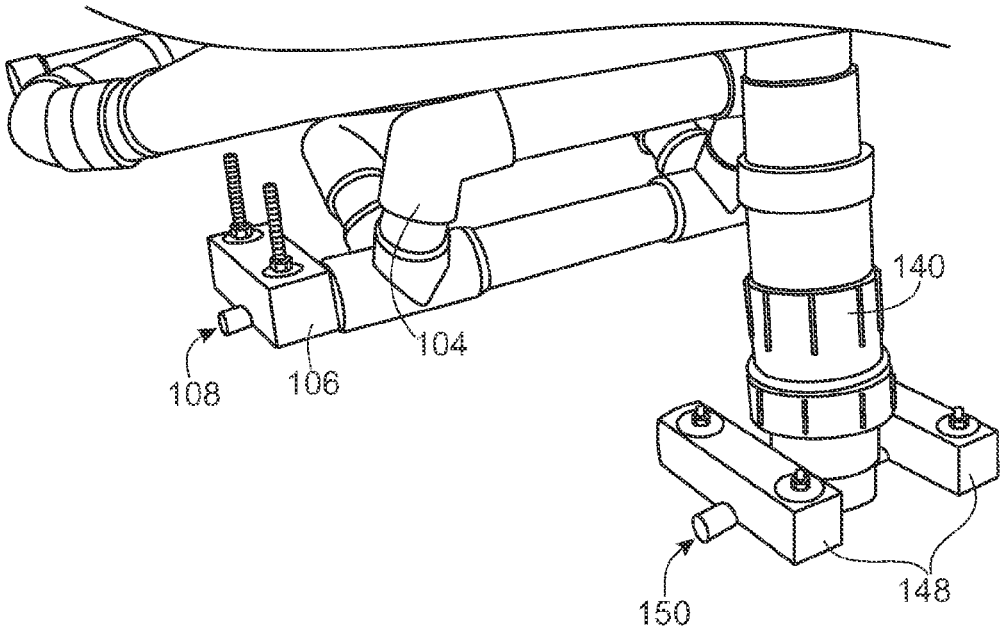
FIG. 7 illustrates aspects of the pump shown in FIG. 1 viewed from underneath.
Figure 8:
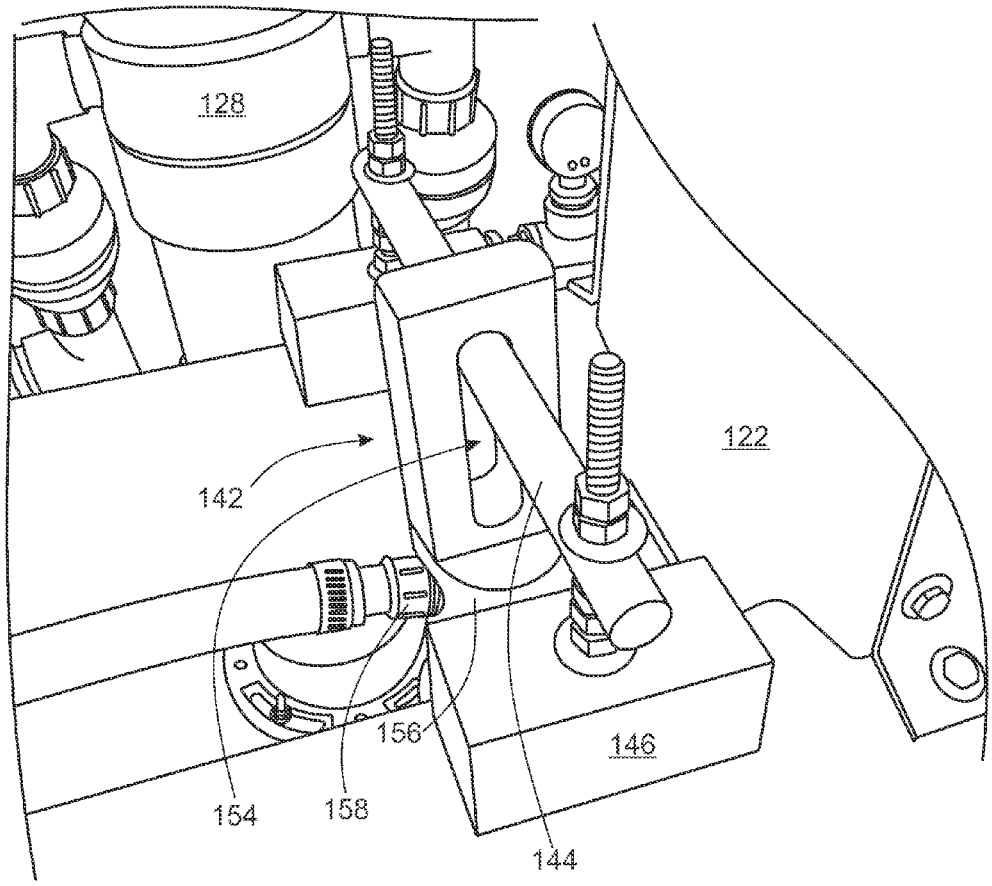
FIG. 8 illustrates aspects of the pump shown in FIG. 1 in greater detail with a focus on the brackets and rods that connect the lever arms to the pistons.
Figure 9:
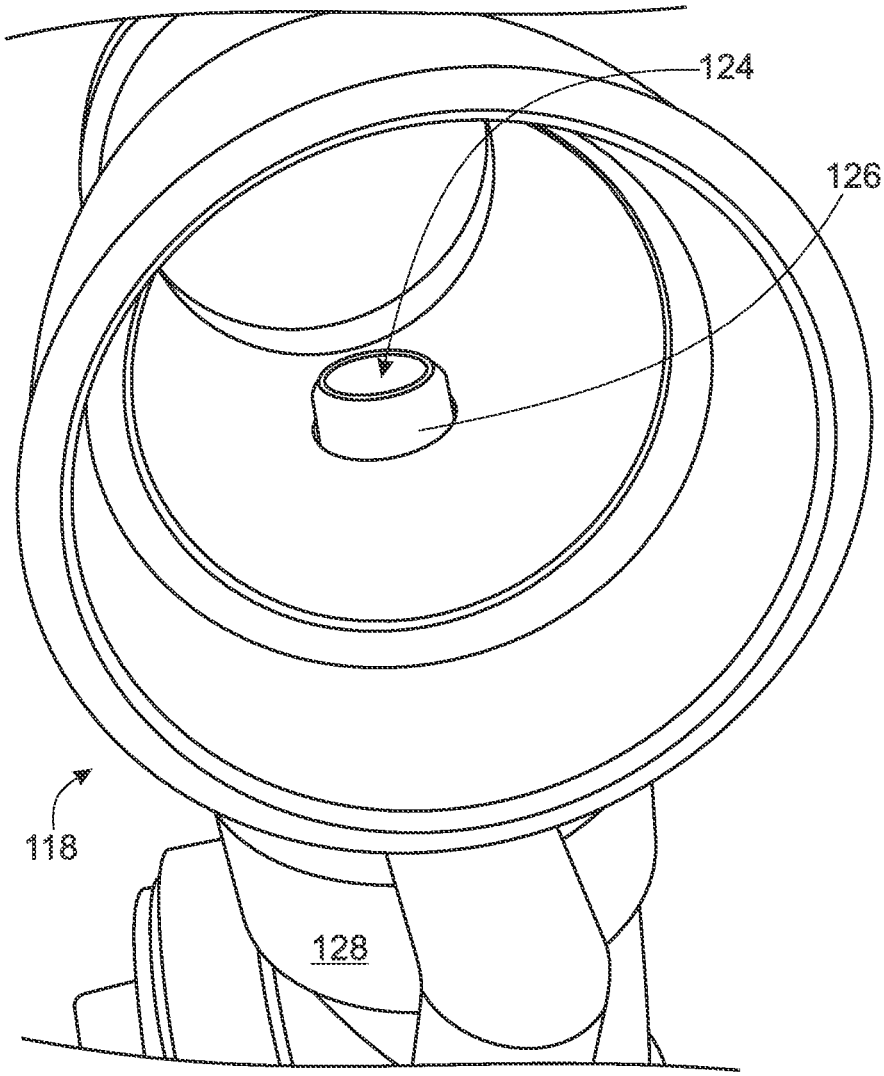
FIG. 9 illustrates aspects of the pump shown in FIG. 1 in greater detail with a focus on the source pipe.
Figure 10:
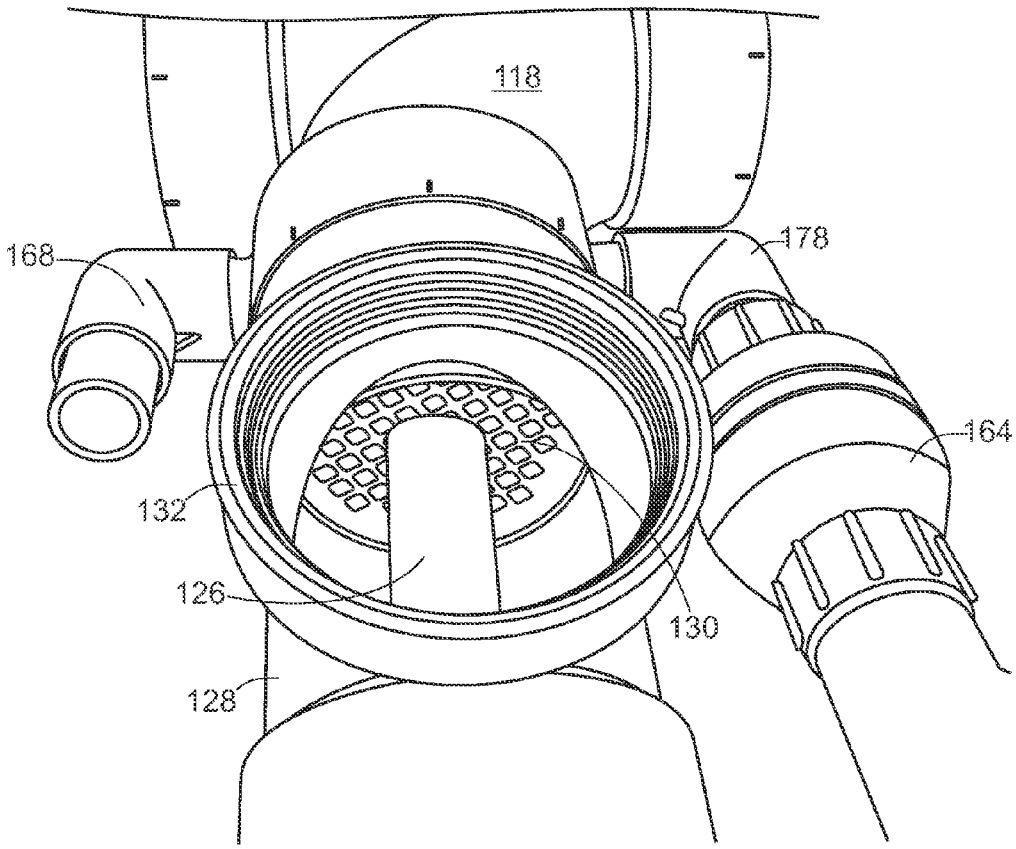
FIG. 10 illustrates aspects of the pump shown in FIG. 1 in greater detail with a focus on the chamber.
Figure 11:
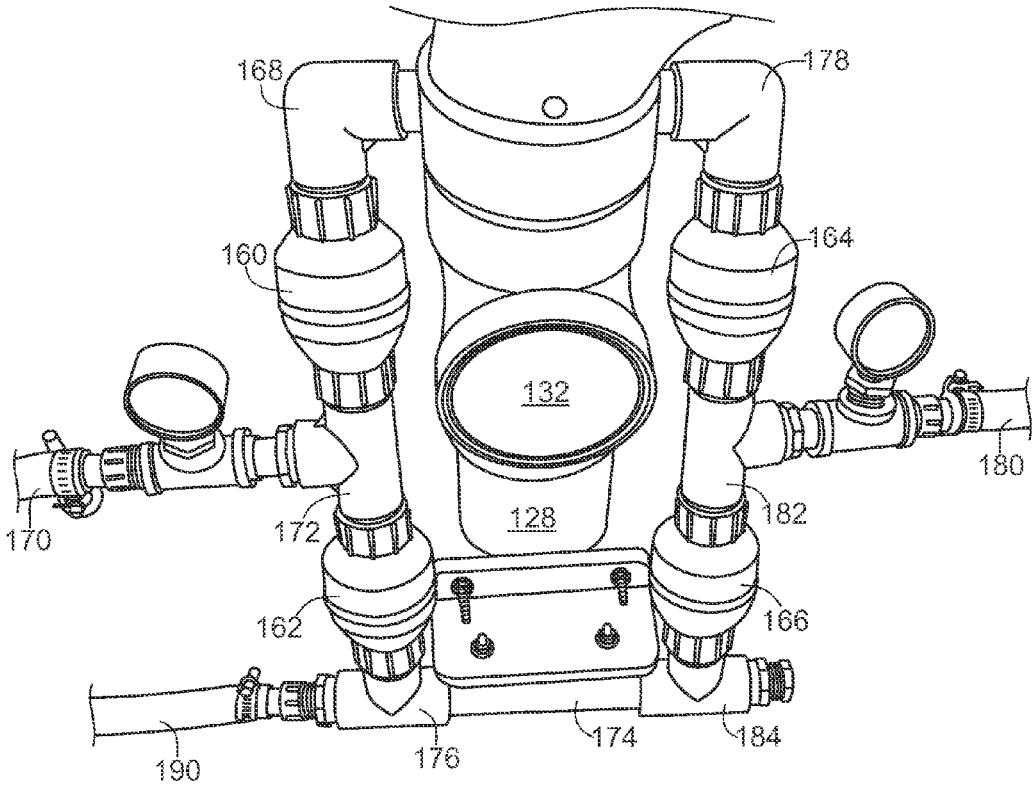
FIG. 11 illustrates aspects of the pump shown in FIG. 1 in greater detail with a focus on the valve tower.
Figure 12:
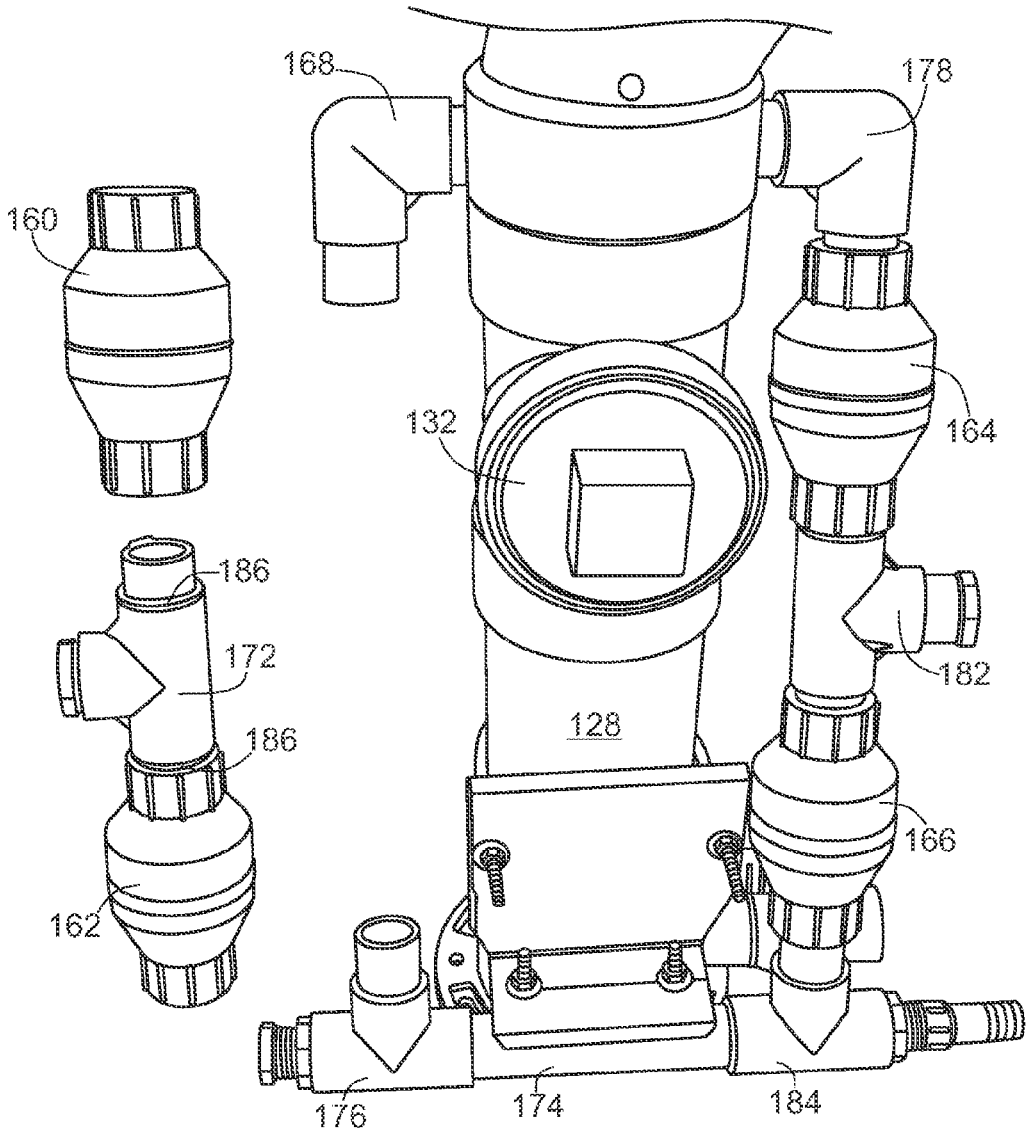
FIG. 12 illustrates aspects of the pump shown in FIG. 1 in greater detail with a focus on the valve tower in a partially disassembled state.
Figure 13:
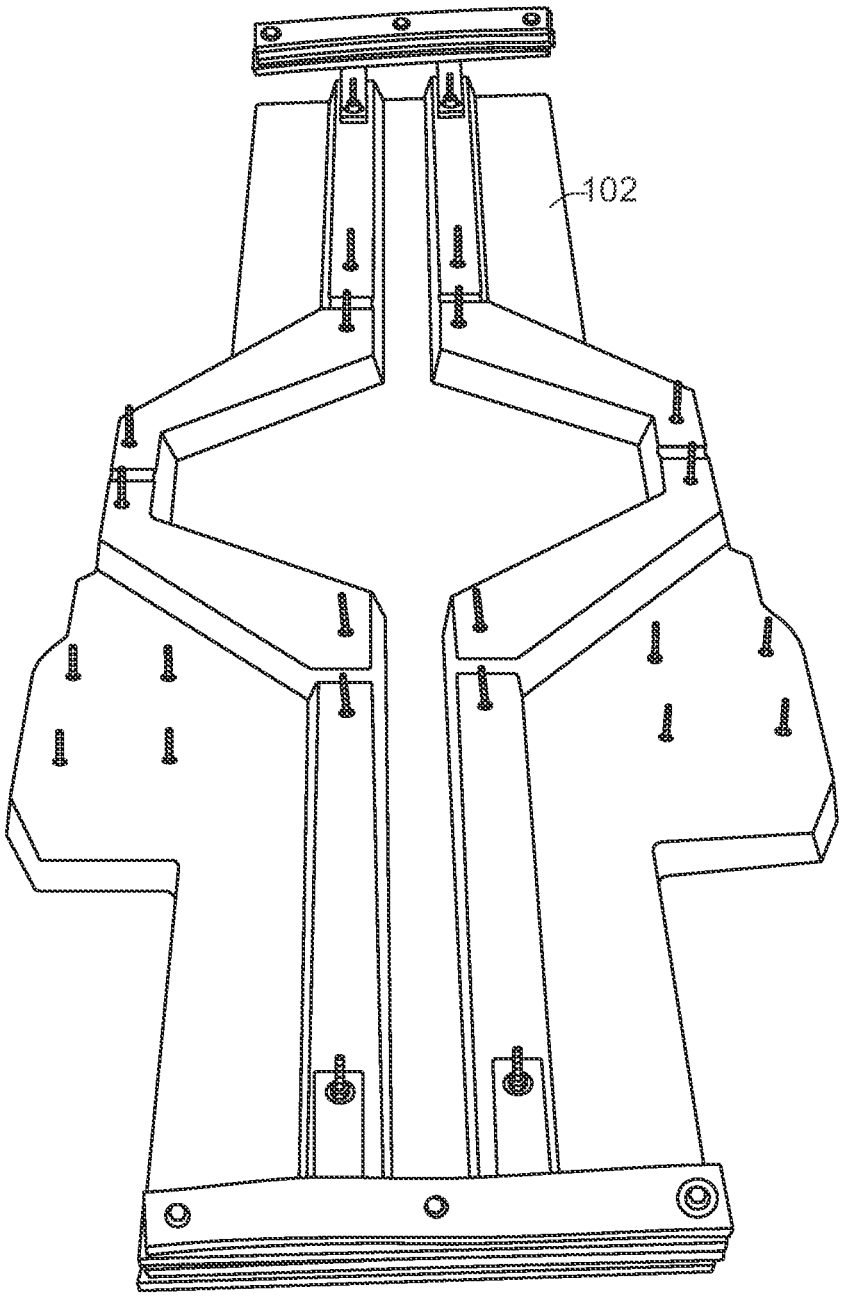
FIG. 13 illustrates aspects of the pump shown in FIG. 1 in greater detail with a focus on the base.

A preferred embodiment of a pump 100 constructed in accordance with the present invention is shown in FIGS. 1-13. In a preferred embodiment, pump 100 comprises a base 102, which may preferably be constructed from concrete or another heavy material to provide a stable platform for the pump and prevent the pump from moving during operation. As shown in FIG. 13, bolts or other suitable hardware may be embedded in base 102 to facilitate affixing other components of pump 100 to base 102. These include a fulcrum 104 that may be rotatably attached to base 102 by a block 106 and pin 108.

Pump 100 further preferably comprises a first pair of lever arms 110, and a second pair of lever arms 112, each attached to fulcrum 104. It should be noted that although described herein as separate elements, each lever arm 110 and lever arm 112 may in practice be constructed from a single continuous piece of pipe separated into two parts by a seal or other separator within the pipe.

Each pair of lever arms 110,112 is preferably respectively joined at its distal end by an end piece 114 comprising an outlet 116 through which water from lever arms 110,112 may exit the pump, as described in more detail below. In a preferred embodiment, lever arms 110,112 and/or end pieces 114 may be structured to include a concave bend or curve so that pump 100 may be more fully rotated during operation without having lever arms 110,112 or end pieces 114 contact the ground or surface of the water source. In this connection, it should be noted that the efficiency of pump 100 may decrease if the water level of the source rises sufficiently to cover outlets 116 in whole or in part during the phases of pump operation (described in more detail below) that outlets 116 discharge water back to the water source.

Pump 100 further comprises a source pipe 118 adapted to receive water (or other liquid) from a stream or other source. Source pipe 118 preferably comprises two outlets, a first outlet 120 adapted to pass most of the water received via source pipe 118 to lever arms 110,112 via a partitioned waterbox 122, and a second outlet 124 adapted to pass a relatively small proportion of the water received via source pipe 118 (which may preferably be approximately 5%) to a pipe 126. Pipe 126 preferably extends through the top of a chamber 128 so that water flowing out the bottom of pipe 126 fills the chamber. Chamber 128 may preferably be provided with a filter 130 for trapping debris drawn into pump 100 from the water source. An inspection and cleaning port 132 is also provided to permit access to the inside of chamber 128 for cleaning filter 130. Chamber 128 may further preferably be provided with a stopcock (not shown) near the bottom of the chamber to permit the chamber to be emptied. Periodic emptying of the chamber permits flushing of heavier detritus such as pebbles or sand that may collect and settle at the bottom of chamber 128.

Waterbox 122 is preferably affixed to lever arms 110,112 so that waterbox 122, lever arms 110,112, and fulcrum 104 collectively form a rotating assembly 134 adapted to rotate about pin 108. Waterbox 122 is preferably positioned relative to source pipe 118 so that: (i) when rotating assembly 134 is rotated clockwise of center, water is directed from outlet 122 to the left side of waterbox 122 (when viewed from the front of the pump) and then into lever arms 110 through inlets 136; and (ii) when rotating assembly 134 is rotated counterclockwise of center, water is directed to the right side of waterbox 122 (when viewed from the front of the pump) and then into lever arms 112 through inlets 138.

Pump 100 further preferably comprises a pair of pistons 140 connected to lever arms 110,112 via brackets 142, rods 144 and blocks 146. In some embodiments, a pair of rings (not shown) may be positioned along each rod 144 on either side of bracket 142 for additional stability if required. Pistons 140 are preferably connected to base 102 by a block 148 and rod 150 to permit some rotation of piston 140 about rod 150 during operation of pump 100. In a preferred embodiment, each piston 140 is located between one pair of lever arms 110,112 to avoid the creation of twisting forces which may cause unnecessary wear on pump 100. In addition, in a preferred embodiment, pistons 140 are positioned relatively close to fulcrum 104 which helps prevent the pump stalling.

Piston size may be adjusted as desired keeping in mind that decreasing piston diameter generates higher pressure (permitting water to be pumped higher or further) but decreases the volume of pumped water. Increasing piston size has the opposite effects.

Each bracket 142 preferably comprises an upper portion 152 having formed therein an elongated slot 154 adapted to slidably hold rod 144, and a lower portion 156 for attaching to piston 140. Lower portion 156 preferably comprises an outlet 158 adapted to receive a hose (described below). Because of elongated slot 154, rotation of assembly 134 from the fully clockwise-rotated or fully counterclockwise-rotated positions will not immediately apply any force to pistons 140. Rather, initial rotation of assembly 134 causes rod 144 to slide up or down within slot 154 until it reaches the end of the slot. Only then, once some momentum has been built up in rotating assembly 134, is force applied to pistons 140 to raise or lower the pistons. This feature of the preferred embodiment helps rotating assembly 134 to drive pistons 140, which would be more difficult if rotating assembly 134 immediately engaged pistons 140 when first changing its direction of rotation.

Pump 100 further comprises four one-way valves 160-166. A first valve 160 is connected to chamber 128 via an elbow 168 and to a hose 170 via a T-junction 172 and is oriented to permit water flow only from chamber 128 to hose 170. A second valve 162 is connected to hose 170 via T-junction 172 and to an outlet pipe 174 via a T-junction 176 and is oriented to permit water flow only from hose 170 to outlet pipe 174. A third valve 164 is connected to chamber 128 via an elbow 178 and to a hose 180 via a T-junction 182 and is oriented to permit water flow only from chamber 128 to hose 180. Finally, a fourth valve 166 is connected to hose 180 via T-junction 182 and to outlet pipe 174 via a T-junction 184 and is oriented to permit water flow only from hose 180 to outlet pipe 174.

In a preferred embodiment, valves 160-166 are attached to T-junctions 172,176,182,184 and elbows 168,178 by a friction fit to permit simple service and replacement. O-rings 186 may be provided to facilitate improved sealing at the friction fit junctions.

In operation, source pipe 118 is preferably placed in contact with a source of water (or other liquid) such as a stream or lake via, for example, a pipe 188. Water from the source preferably has either kinetic energy (e.g., from stream flow) or potential energy (e.g., from being located higher than the pump), or a combination of the two, which provides the energy used to drive pump 100, as described in more detail below. Water pumped by pump 100 may preferably be delivered from outlet pipe 174 through a hose 190 to any desired location within the hose's reach to provide water for irrigation, drinking, or any other purpose.

The preferred embodiment of pump 100 shown in FIGS. 1-13 operates in two half-cycles and pumps water during each half-cycle. At the beginning of the first half-cycle, assembly 134 is rotated fully in the clockwise direction. Water entering source pipe 118 is directed from outlet 120 into the left part of waterbox 122 (viewed from the front of the pump) and then through inlets 136 into lever arms 110. As the amount of weight in lever arms 110 increases, assembly 134 begins to rotate in a counterclockwise direction. At first, this rotation causes rods 144 to slide within slots 154 of brackets 142 without immediately applying any force to pistons 140. As noted above, this facilitates operation of pump 100 because it permits rotating assembly 134 to build up some momentum before engaging pistons 140.

Once rods 144 reach the end of slots 154, continued rotation of assembly 134 begins driving pistons 140. In the first half-cycle, this causes the piston 140 on the right side of pump 100 (when viewed from the front) to rise, drawing water into the piston from chamber 128 through one-way valve 160 and hose 170. Concurrently, the piston 140 on the left side of pump 100 (when viewed from the front) is compressed, pumping water out of the piston through hose 180, one-way valve 166, and outlet pipe 174.

Counterclockwise rotation of assembly 134 also causes lever arms 112 to rise and lever arms 110 to descend so that the water in lever arms 110 flows toward their distal ends and exits the pump through outlet 116. In a preferred embodiment, water exiting the pump is delivered back into the river or other water source from which the water was taken. In an alternative preferred embodiment concrete basins may be positioned under outlets 116 to prevent water exiting the pump from eroding the stream bed. Water exiting the pump, lightens the weight of lever arms 110 and facilitates the next half-cycle of pump operation during which lever arms 110 rise, as described below.

Turning now to the second half-cycle of pump operation, this half-cycle begins with assembly 134 rotated fully in the counterclockwise direction. Water entering source pipe 118 is directed into the right part of waterbox 122 (viewed from the front of the pump), and then through inlets 138 into lever arms 112. As the amount of weight in lever arms 112 increases, assembly 134 begins to rotate in a clockwise direction. As above, this rotation causes rods 144 to slide within slots 154 of brackets 142 without immediately applying any force to pistons 140. As noted above, this aids pump operation because it permits rotating assembly 134 to build up some momentum before engaging pistons 140.

Once rods 144 reach the end of slots 154, continued rotation of assembly 134 begins driving pistons 140. In this second half-cycle, this causes the piston 140 on the left side of pump 100 (when viewed from the front) to rise, drawing water into the piston from chamber 128, through one-way valve 164 and hose 180. Concurrently, the piston 140 on the right side of pump 100 (when viewed from the front) is compressed, pumping water out of the piston through hose 170, one-way valve 162, and outlet pipe 174.

Clockwise rotation of assembly 134 also causes lever arms 110 to rise and lever arms 112 to descend so that the water in lever arms 112 flows toward their distal ends, and exits the pump through outlet 116 preferably back into the river or other water source from which the water was taken. Alternatively, as described above, concrete basins may be positioned under outlets 116 to prevent water exiting the pump from eroding the stream bed. Water exiting the pump lightens the weight of lever arms 112 and facilitates the next half-cycle of pump operation during which lever arms 112 will rise, as described above.

In a preferred embodiment, pump 100 further comprises an expansion chamber/bladder 192 to smooth out discontinuities in pump output caused by the fact that the pump operates in two distinct half-cycles and allow for a more steady continuous flow from the pump. An exemplary expansion chamber/bladder suitable for this purpose is a two gallon expansion tank available from Utilitech of Charlotte, N.C. Alternatively, a suitable expansion chamber/bladder 192 may be constructed using a chamber housing a bicycle tube that is adapted to form a sealed rubber bladder that can compress and expand as it is exposed to water output by pump 100 to absorb and smooth out the discontinuity in the pump output. If desired, the expansion chamber/bladder need not be affixed to pump 100 and may instead be located several feet away from the pump and connected to the pump by suitable length hoses.

In a preferred embodiment, non-contaminating lubricants (e.g., Crisco) are used for any components of pump 100 requiring lubrication to avoid contamination of the water source and the water being pumped.

It should be noted that although FIGS. 1-13 illustrate a pump constructed using a specific set of materials, including concrete and PVC pipe, the pump of the present invention may in other preferred embodiments be constructed from other materials so long as their physical properties permit them to perform the functions set out above. For example, embodiments of the pump of the present invention could be created by rotomolding the pump elements described herein into two components, one comprising the left half of the pump and the other comprising the right half of the pump. The components may then be shipped to any desired destination where they may be assembled to create the pump of the present invention.

In addition, although the preferred embodiment illustrated in FIGS. 1-13 comprises two lever arms on each side of the pump, the pump could be modified to include one lever arm or more than two lever arms on each side. Furthermore, although the preferred embodiment illustrated in FIGS. 1-13 comprises two pistons, one on each side of the pump, the pump could be modified to include a piston only on one side of the pump or to include more than one piston on one or both sides of the pump. In a preferred embodiment, where the pump is constructed with a single piston, a double action piston that pumps water on both half-cycles of operation may be used.

It should further be noted that, although in the preferred embodiment shown in FIGS. 1-13 a single water source is used to provide both the energy for driving the pump and the water to be pumped, construction of the pump of the present invention may be modified so that the pump comprises a first inlet connected to one water source (or other liquid) that is used to drive rotating assembly 134, and a second inlet connected to a second water source (or other liquid) to provide the water (or other liquid) to be pumped. In this alternative embodiment, the first inlet may feed water to rotating assembly 134 and the second inlet may feed water to chamber 128.

More generally, although the present disclosure has been described in relation to particular embodiments, many other variations, modifications, and other use of the present invention will be apparent to those skilled in the art. Accordingly, the scope of the present invention should be limited not by the specific disclosure herein, but only by the appended claims.

The invention claimed is:

1. A pump, comprising:

an input adapted to receive water from a source;

a first lever arm in fluid communication with said input, said first lever arm being rotatable in response to water from said source being alternately provided to and emptied from said first lever arm;

a reciprocating member driven by the first lever arm, said reciprocating member adapted to draw and pump water in response to rotation of said first lever arm;

a second lever arm;

a water router adapted to alternately deliver water to the first lever arm when the pump is rotated in a first direction and to deliver water to the second lever arm when the pump is rotated in a second direction;

a linking member for delivering driving force from the first lever arm to the reciprocating member, said linking member comprising:

a rod connected to said first lever arm;

a bracket connected to the reciprocating member;

the bracket comprising a slot;

the rod being slidably engaged within the slot;

wherein said driving force is first delivered from said first lever arm to the reciprocating member when movement of the first lever arm causes said rod to reach to the end of the slot.

2. The pump of claim 1, further comprising:

an end piece connected to the first lever arm;

said end piece having an outlet that receives water being emptied from said first lever arm and discharges said received water from the pump.

3. The pump of claim 2, wherein the water is discharged to the source.

4. The pump of claim 2, wherein the water is discharged into basins to protect against erosion of the source.

5. The pump of claim 1, further comprising:

a chamber for receiving water from the source;

a first one way valve oriented to pass water from the chamber to the reciprocating member in response to a said rotation in the first direction; and a second one way valve oriented to pass water from the reciprocating member to an outlet of the pump in response to said rotation in the second direction.

6. The pump of claim 5, wherein the first one way valve and second one way valve are installed in the pump using a friction fit.

7. The pump of claim 1, further comprising:

a chamber for receiving water from the source;

wherein water to be delivered to the reciprocating member is drawn from the top of the chamber such that detritus in the water pulled by gravity to the bottom of the chamber is prevented from entering the reciprocating member.

8. The pump of claim 7, further comprising a stopcock for emptying the chamber.

9. The pump of claim 1, wherein the reciprocating member is a single action piston.

10. The pump of claim 1, wherein the reciprocating member is a double action piston.

11. The pump of churn 1, further comprising a second reciprocating member.

12. The pump of claim 1, wherein said pumped water is not from the source.

13. A pump, comprising:

an input adapted to receive liquid from a source;

a lever arm in fluid communication with said input, said lever arm being rotatable in response to liquid from said source being alternately provided to and emptied from said lever arm;

a reciprocating member driven by the lever arm, said reciprocating member adapted to draw and pump liquid in response to rotation of said lever arm;

a rod connected to said lever arm;

a bracket connected to the reciprocating member;

the bracket comprising a slot; and the rod being slidably engaged within the slot;

wherein said driving force is first delivered from the lever arm to the reciprocating member when movement of the lever arm causes said rod to reach to the end of the slot.

* * * * *